US006652185B1

(12) United States Patent
Frey

(10) Patent No.: US 6,652,185 B1
(45) Date of Patent: Nov. 25, 2003

(54) FAST EFFICIENT PERMANENT PAVEMENT REPAIR MATERIAL SYSTEM

(76) Inventor: William D. Frey, 3201 W. 98 St., Leawood, KS (US) 66206

( * ) Notice: Subject to any disclaimer, the term of this patent is extended or adjusted under 35 U.S.C. 154(b) by 0 days.

(21) Appl. No.: 10/229,254

(22) Filed: Aug. 28, 2002

(51) Int. Cl.[7] ..... E01C 11/16
(52) U.S. Cl. ..... 404/70; 404/75
(58) Field of Search ..... 404/17, 70, 71, 404/75; 427/136; 428/543

(56) References Cited

U.S. PATENT DOCUMENTS 3,713,297 A * 1/1973 Hochbach ..... 405/264
4,106,296 A * 8/1978 Leonard et al. ..... 405/264
4,107,112 A * 8/1978 Latta et al. ..... 523/132
4,588,753 A * 5/1986 Miutel et al. ..... 521/86
4,699,542 A * 10/1987 Shoesmith ..... 404/82
4,915,539 A * 4/1990 Yoshikane et al. ..... 404/31
4,957,390 A * 9/1990 Shoesmith ..... 404/70
5,246,306 A * 9/1993 Shoesmith et al. ..... 404/70
5,395,866 A * 3/1995 Ross et al. ..... 523/512
5,494,741 A * 2/1996 Fekete et al. ..... 428/331

* cited by examiner

*Primary Examiner*—Gary S. Hartmann

(57) ABSTRACT

Disclosed is a repair composite for pavement and pothole repair. The repair composite is composed of an amount of an isophalic polyester casting resin premixed with dry silica sand, cobalt in combination with dimethylanaline, and a catalyst, such as Lupersol® (methly ethyl ketone peroxide catalyst). Additionally, the composite may include reinforcing structures.

3 Claims, No Drawings

FAST EFFICIENT PERMANENT PAVEMENT REPAIR MATERIAL SYSTEM

BACKGROUND OF THE INVENTION

The field of endeavor to which this invention pertains is the construction industries methods and materials used to repair and patch asphalt, cement road surfaces, parking lots, sidewalks, concrete floors, patios, and many other surfaces.

This invention is designed to eliminate many of the problems that exist with present methods and materials.

The existing problems related to road repair are forming a smooth transition from existing road surfaces and the repaired areas without the depressions and washboard like areas. To provide a more flexible structure, eliminating brittle concrete or loosely bonded asphalt that results in crumbling.

Cracking and a rapid deterioration of already repaired areas, caused by thawing and freezing, as it currently exists with the very porous asphalt patches, will be eliminated. This invention will create a very sound, resilient repair that is resistant to salt and other chemicals as well.

This invention will provide the ability for much smaller crews to be needed to repair damaged areas in a quicker and much more efficient manner.

This invention will provide long lasting, permanent repair and will eliminate the need to constantly redo existing work. This will result in a great cost savings, as well as much better road surfaces.

This system has many safety factors. Much less time is spent by the road crews actually repairing the surfaces, and with the quick setup time, the driving public does not experience the hazardous and possibly dangerous conditions associated with long periods of repair time. This system should serve the public extremely well.

BRIEF SUMMARY OF THE INVENTION

This invention is designed to greatly improve and simplify the process of repairing potholes and all other deterioration of asphalt and concrete surfaces.

The object of this invention is to provide a longer lasting and more efficient system of road repair. This material and system offer tremendous cost savings to all federal, state, and local municipalities. The driving public will benefit greatly as well by having smoother roads thus causing less damage to their vehicles. The present methods require repeated repairs to the same areas many times in the weeks and months ahead. This material will eliminate that problem.

The use of this composite will eliminate the use of most of the heavy equipment normally used in road repair.

The use of this composite will substantially reduce the down time of the roadways due to its very simple application and fast curing time. The elimination of surface distortion provides a great benefit to the driving public because it will efficiently upgrade the quality of the roadways and last much longer than previous methods.

DETAILED DESCRIPTION OF THE INVENTION

This invention is designed in two parts. One is the pavement and pothole repair composite, with reinforcing structures. The other is a method of application. They work together to formulate a very fast, efficient, permanent pavement repair material and application method. This is comprised of a specially formulated composite of a non aqueous liquid made of isophalic polyester casting resin mixed with 70% by volume of dry silica sand and 30% by volume liquid isotholic polyester casting resin and 0.1% to 0.250% cobalt combined with 250 parts per million of dimethylanaline to provide a gel time of 11 minutes and a cure time of 100 minutes or less. This also includes a number of reinforcement structures like industrial glass marbles, perforated sheet steel, rip rap, glass woven roving cloth 18 ounce—24 ounce, pre-molded fiberglass grid structure with ½" to ¾" diameter segments, pre-molded and sized to fit a number of repair conditions. The use of precut sections of used tire segments as a reinforcement, which solves the problem of what to do with millions of used tires. This makes an inexpensive recyclable use. The composite is catalyzed with a small container of Lupersol® DDM-9 (methyl ethyl ketone peroxide catalyst) at 1.25% by volume and mixed in a 5 gallon container with ½" air drill with a mixing bit, for about two minutes. Black or gray color may be added at this time.

The repair area or pothole should be blown free of debris and all moisture with a blow gun powered by a truck mounted 15–20 horsepower air compressor. The composite is then poured from the 5-gallon container into the repair area or pothole. It is poured about half full at that time. The reinforcing structure is placed in the repair area or pothole so that it sets about half way up in the repair area. Continue to fill the repair area or pothole. Screed and finish off smooth. Proceed to the next repair area. The composite will cool in about 11 minutes and cure in about 100 minutes. This repair will result in a very smooth, nonporous, even repair with good road surface quality, excellent thermal shock resistance, and high impact strength, with excellent physical properties. This repair composite will be resistant to any chemicals, as well as salt.

The method and process using this pavement and pothole repair composite and equipment required is described as follows:

The equipment required will be one flatbed truck equipped with one 15–20 horsepower gas operated compressor to operate a blowgun for cleaning out repair areas or potholes; on ½" air operated drill with mixing bit; one small air operated saw and several hand tools; one safety bucket containing acetone for tool cleaning; a full load of the repair composite in 5 gallon containers for convenient storage and handling.

Step One: Remove all debris and moisture from the repair area or pothole to make sure it is as dry as possible. Open container of composite and mix in the proper amount of catalyst and color, if desired, and mix for about 2–3 minutes using the air drill with mixing bit.

Step Two: Pour the composite into the repair area or hole about half full. Insert the reinforcing structure about half way up the wall of the repair area. Pour repair area full, then finish and screed off smoothly, placing any excess material into the next repair area or pothole.

Step Three: The material will gel in about 11 minutes and will cure hard in about 100 minutes or less, depending on temperatures and weather conditions, to form a nonporous repair structure with little or no water absorption.

The results will be a smooth, hard, nonporous finish with good traction capabilities. This operation may be performed many times a day very quickly and easily, unlike the normal repairs made with hot asphalt requiring time consuming labor and many different pieces of expensive equipment to complete the job. The repairs with asphalt are temporary, at best, and usually leave the repaired area with humps and bumps and very uneven surfaces. Summer heat attacks the repaired areas and distorts even more. In winter the thawing and freezing may destroy an asphalt repair in a matter of days. To leave the road condition worse than it was to start with. So the benefits of using the fast, efficient permanent pavement repair and material system are: much less equipment expense, less labor costs, not repeat repair, quality repair with no bumps or depressions, better appearance with color matching capabilities. There will be little or no water seepage between existing material and repaired areas, which eventually thaw and freeze and cause separation, cracking and erosion of existing material and repair materials. There will be less roadway downtime, as with concrete that requires 48 hours or longer to cure and not successfully seal the joint between existing materials and the repair, and requires the use of expensive concrete trucks and drivers. The concrete is very susceptible to salt and other corrosive material and to chip loose at the joints, spalling, cracking and crumbling. This repair composite may also be used to repair shallow cracks and pits very quickly. There is appreciable merit to the simplicity of this composite repair material and the application process.

What is claimed is:

1. A pavement and pothole repair composite, comprising:

(a) a non-aqueous liquid isophalic polyester casting resin, the non-aqueous liquid isopholic polyester casting resin comprises a base mixture of 70% by volume dry silica and 30% by volume liquid isotholic polyester casting resin;

(b) a cobalt mixture added to the base mixture in an amount equal to between 0.1% to 0.250% by volume of the non-aqueous liquid isophalic polyester casting resin with 250 parts per million of dimethylanaline, to form the pavement and pothole repair composition; and, (c) a catalyst added to the pavement and pothole repair composition in an amount equal to 1.25% by volume of the pavement and pothole repair composition, the catalyst is a methyl ethyl ketone peroxide catalyst.

2. The pavement and pothole repair composite of claim 1, comprising:

a reinforcing structure selected from the group consisting of precut ½" steel rebar fabrication, industrial glass marbles ½" to ¾" in diameter, perforated sheet steel, pre-molded fiberglass grid, and precut sections of used tire carcass.

3. A method of repairing pavement and potholes, comprising:

(a) using only two workers, a single flat bed truck equipped with a gasoline powered 15 to 20 horsepower, air compressor for operating a 1 to 2½" air drill and blowgun with mixing bits, and assorted hand tools for preparing the area;

(b) preparing the area to be repaired by blowing, to clean and dry the repair area;

(c) combining a non-aqueous liquid isophalic polyester casting resin contained within a 5 gallon container, the non-aqueous liquid isopholic polyester casting resin comprises a base mixture which is 70% by volume dry silica and 30% by volume liquid isotholic polyester casting resin, and a cobalt mixture of 0.1% to 0.250% by volume of the non-aqueous liquid isopholic polyester casting resin with 250 parts per million of dimethylanaline;

(d) combining a catalyst of 1.25% by volume of a pavement and pothole repair composition, the catalyst is a methyl ethyl ketone peroxide catalyst, with the non-aqueous liquid isophalic polyester casting resin, for approximately two minutes, to produce the pavement and pothole repair composition;

(e) pouring the pavement and pothole repair composition into the area to be repaired until area is half full of the pavement and pothole repair composition;

(f) inserting into the pavement and pothole repair composition the reinforcing structure, the reinforcing structure selected from the group consisting of precut ½" steel rebar fabrication, industrial glass marbles ½" to ¾" in diameter, perforated sheet steel, pre-molded fiberglass grid, and precut sections of used tire carcass;

(g) filling the repair area with the pavement and pothole repair composition, and then screed and finish smooth; and, (h) curing the composition for between 1 and 100 minutes.

* * * * *